US005549511A

United States Patent [19]

Cronin et al.

[11] Patent Number: 5,549,511

[45] Date of Patent: Aug. 27, 1996

[54] VARIABLE TRAVEL CARRIER DEVICE AND METHOD FOR PLANARIZING SEMICONDUCTOR WAFERS

[75] Inventors: John E. Cronin; Matthew J. Rutten, both of Milton, Vt.

[73] Assignee: International Business Machines Corporation, Armonk, N.Y.

[21] Appl. No.: 349,848

[22] Filed: Dec. 6, 1994

[51] Int. Cl.[6] ..... B24B 7/00; B24B 17/00

[52] U.S. Cl. ..... 451/281; 451/288

[58] Field of Search ..... 451/41, 237, 239, 451/281, 288, 289, 921, 225, 526, 533, 290, 548, 550, 287, 291

[56] References Cited

U.S. PATENT DOCUMENTS 4,593,495 6/1986 Kawakami et al. ..... 451/291
5,234,867 8/1993 Schultz et al. ..... 437/225
5,267,418 12/1993 Currie et al. ..... 51/216 R
5,421,769 6/1995 Schultz et al. ..... 451/288

FOREIGN PATENT DOCUMENTS 5-251411 5/1993 Japan .

*Primary Examiner*—D. S. Meislin
*Assistant Examiner*—Derris Banks
*Attorney, Agent, or Firm*—Heslin & Rothenberg, P.C.

[57] ABSTRACT

A chemical mechanical planarization tool and method are presented employing a non-linear motion of the carrier arm relative to the polishing pad. The non-linear motion of the carrier arm relative to the polishing pad can be accomplished in a variety of ways, for example, employing a mechanical template having an irregular opening or programming the carrier displacement mechanism to move the carrier in an irregular, non-rotational X-Y path over the polishing pad.

5 Claims, 5 Drawing Sheets

VARIABLE TRAVEL CARRIER DEVICE AND METHOD FOR PLANARIZING SEMICONDUCTOR WAFERS

TECHNICAL FIELD

This invention relates in general to apparatus for planarizing semiconductor wafers, and more particularly, to chemical mechanical planarization (CMP) devices and methods. Further, the invention relates to a variable travel control device/method for enhanced planarization of semiconductor wafers.

BACKGROUND ART

At various stages of the integrated circuit fabrication process, it is necessary to polish a surface of the semiconductor wafer. In general, a semiconductor wafer can be polished to remove high typography, surface defects such as crystal lattice damage, scratches, roughness or embedded particles of dirt or dust. This polishing process is often referred to as mechanical planarization and is utilized to improve the quality and reliability of semiconductor devices. The process is usually performed during the formation of various devices and integrated circuits on the wafer. The polishing process may also involve the introduction of a chemical slurry to facilitate higher removal rates and selectivity between films of the semiconductor surface. Such a polishing process is referred to as chemical mechanical planarization (CMP).

In general, the CMP process involves holding and rotating a thin flat wafer of semiconductor material against a wetted polishing surface under controlled pressure and temperature. FIG. 1 depicts a conventional CMP device 10 having a rotatable polishing platen 12, a polishing head assembly 14, and a chemical supply system 16. Platen 12 is rotated at a prescribed velocity by motor 18. Platen 12 is typically covered by a replaceable, relatively soft pad material 20 such as blown polyurethane, which may be wetted with a lubricant such as water.

Polishing head assembly 14 includes a carrier 22 which holds the semiconductor wafer (not shown) adjacent to platen 12. Polishing head assembly 14 further includes motor 24 for rotating carrier/semiconductor wafer 22, and a carrier displacement mechanism 26 which linearly moves carrier/semiconductor wafer 22 radially across platen 12 as indicated by arrows 28 and 30. Carrier assembly 14 applies a controlled downward pressure, P, as illustrated by arrow 32, to carrier/semiconductor wafer 22 to hold the wafer against rotating platen 12.

Chemical supply system 16 introduces a polishing slurry (as indicated by arrow 34) to be used as an abrasive medium between platen 12 and the semiconductor wafer. Chemical supply system 16 includes a chemical storage 36 and a conduit 38 for transferring the slurry from chemical storage 36 to the planarization environment atop platen 12.

One problem encountered in CMP processes is the non-uniform removal of the semiconductor surface. Removal rate is directly proportional to downward pressure on the wafer, rotational speeds of the platen and wafer, slurry particle density and size, slurry composition, and the effective area of contact between the polishing pad and the wafer surface. Further, removal caused by the polishing pad is related to the radial position of the wafer on the platen. The removal rate increases as the semiconductor wafer moves radially (i.e., linearly) outward relative to the platen due to a higher platen rotational velocity. Additionally, removal rates tend to be higher at wafer edge than at wafer center because the wafer edge is rotating at a higher speed than the wafer center.

One approach to addressing the problems associated with non-uniform removal across the platen is presented in U.S. Pat. No. 5,234,867, entitled "Method for Planarizing Semiconductor Wafers with a Non-Circular Polishing Pad." As the title indicates, planarizing apparatus is disclosed therein which includes a non-circular pad, mounted atop the platen, which engages and polishes the surface of the semiconductor wafer. A polishing head displacement mechanism moves the polishing head and semiconductor wafer across and past a peripheral edge of the non-circular pad to effectuate a uniform polish of the semiconductor wafer surface. Wafer movement across the pad is linear or radial and is not controlled by the shape of the pad. The drawback of this planarizing apparatus is that the carrier and wafer are intentionally brought partially outside the edge of the pad, which can be very dangerous to the integrity of the wafer. Further, such action can cause the pad edge to curve upwards or downwards or rip upon repeated use, thereby shortening the life of the pad.

Thus, a need continues to exist in the art for an improved planarization process which significantly reduces the problems associated with non-uniform removal across the platen.

DISCLOSURE OF THE INVENTION

Briefly summarized, the present invention comprises in one aspect a polishing device for polishing a surface of a semiconductor wafer. The polishing device includes a polishing pad and a carrier assembly for holding the semiconductor wafer with the surface thereof to be polished in juxtaposition relative to the polishing pad. Means are provided for non-rotationally moving the carrier assembly and/or the polishing pad such that the semiconductor wafer proceeds in a non-linear polishing path over the polishing pad. A means for non-rotationally moving can be implemented using different techniques. For example, a mechanical template or programmable control means may be alternately employed for non-rotationally moving the carrier assembly relative to the polishing pad.

In another aspect, the invention comprises a process for planarizing a semiconductor wafer which includes the steps of: rotating a pad; holding a surface of a semiconductor wafer in juxtaposition relative to the pad; and non-rotationally moving the semiconductor wafer non-linearly over the pad such that the semiconductor wafer travels in an X-Y varying path over the pad.

In all aspects, for maintaining full surface contact of the semiconductor wafer to the polishing pad is maintained at all times during the planarization process. By providing variable or non-linear travel of the semiconductor wafer over the polishing pad, planarization uniformity is optimized and polish pad life is extended. Further, uniformity between processed semiconductor wafers is enhanced using the same polishing pad, since polishing pad wear is more uniform. The concepts presented herein may be readily implemented using a number of different approaches. For example, a mechanical template and software programmable control means are two options discussed. Employing a programmable control can be advantageous in that it allows varying of the rate of rotation of the carrier assembly, varying of the non-linear polishing path of the semiconductor wafer across the polishing pad and varying of the rate of movement of the semiconductor wafer along the non-linear polishing path.

BRIEF DESCRIPTION OF THE DRAWINGS

These and other objects, advantages and features of the present invention will be more readily understood from the following detailed description of certain preferred embodiments of the present invention, when considered in conjunction with the accompanying drawings in which.

BEST MODE FOR CARRYING OUT THE INVENTION

The essential elements of a chemical mechanical planarization (CMP) tool are: (1) the pad, i.e., the polishing surface which the wafer contacts and over which the wafer moves; (2) the carrier, which holds and rotates the semiconductor wafer; and (3) the carrier arm, which holds the carrier/wafer assembly in contact with the pad during a polishing operation. Conventional polishing techniques employ rotation of the carrier holding the wafer coupled with rotation of the pad disposed on the platen. Further, in certain CMP devices, the carrier arm has been moved radially in a linear manner across the surface of the pad.

The present invention employs a non-linear motion of the carrier arm relative to the polishing pad, which improves polishing uniformity and extends pad life. Producing a varied or irregular carrier path relative to the pad surface can be accomplished in a number of ways. For example, a mechanical template can be employed or programming of the carrier displacement mechanism can be implemented to move the carrier in an irregular X-Y path over the polishing pad. The appended claims are intended to encompass all such variations of the polishing concept.

Figure 1:
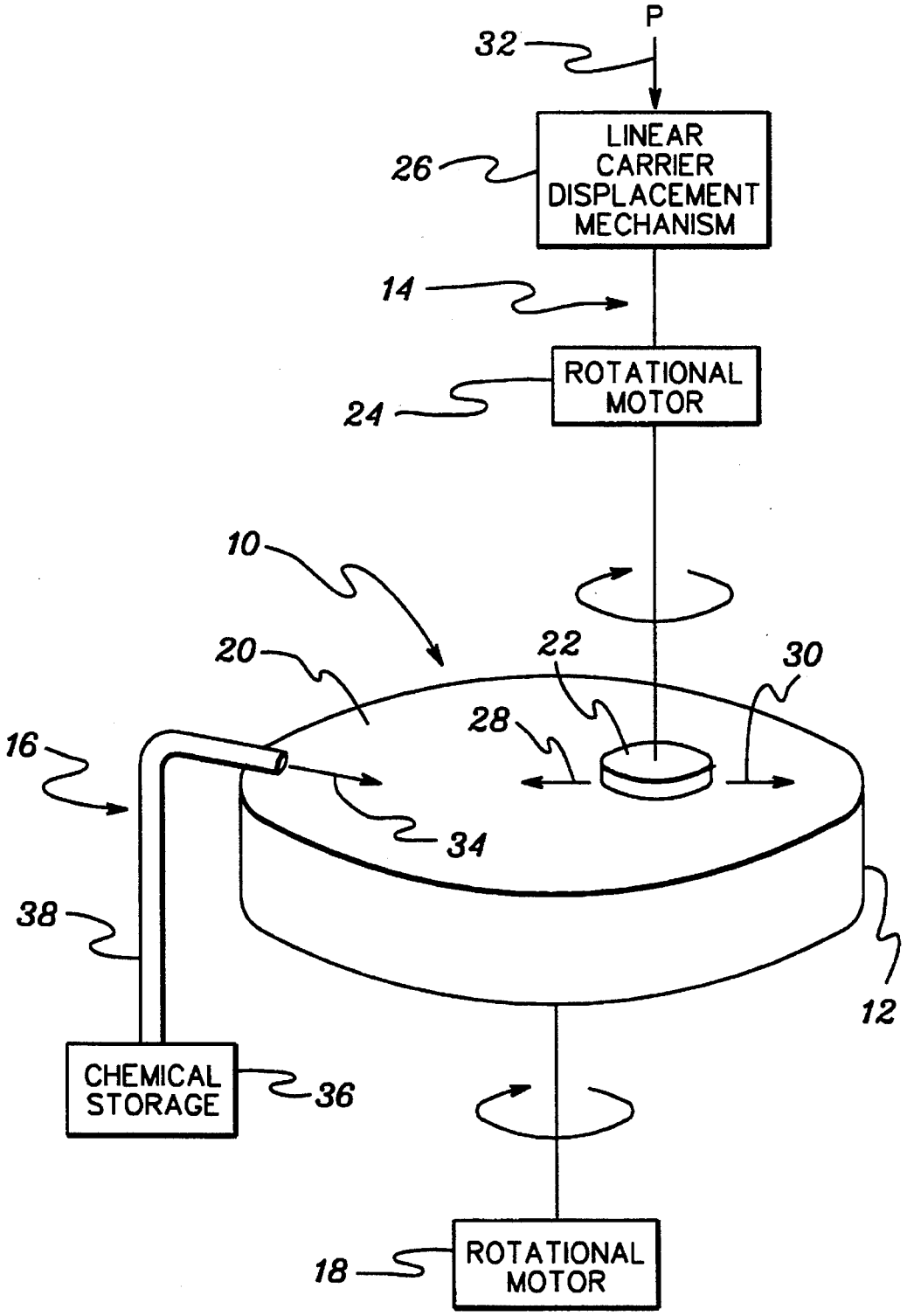
fig. 1 (PRIOR ART)
FIG. 1 is a diagrammatic perspective of a conventional chemical mechanical planarization device.
Figure 2:
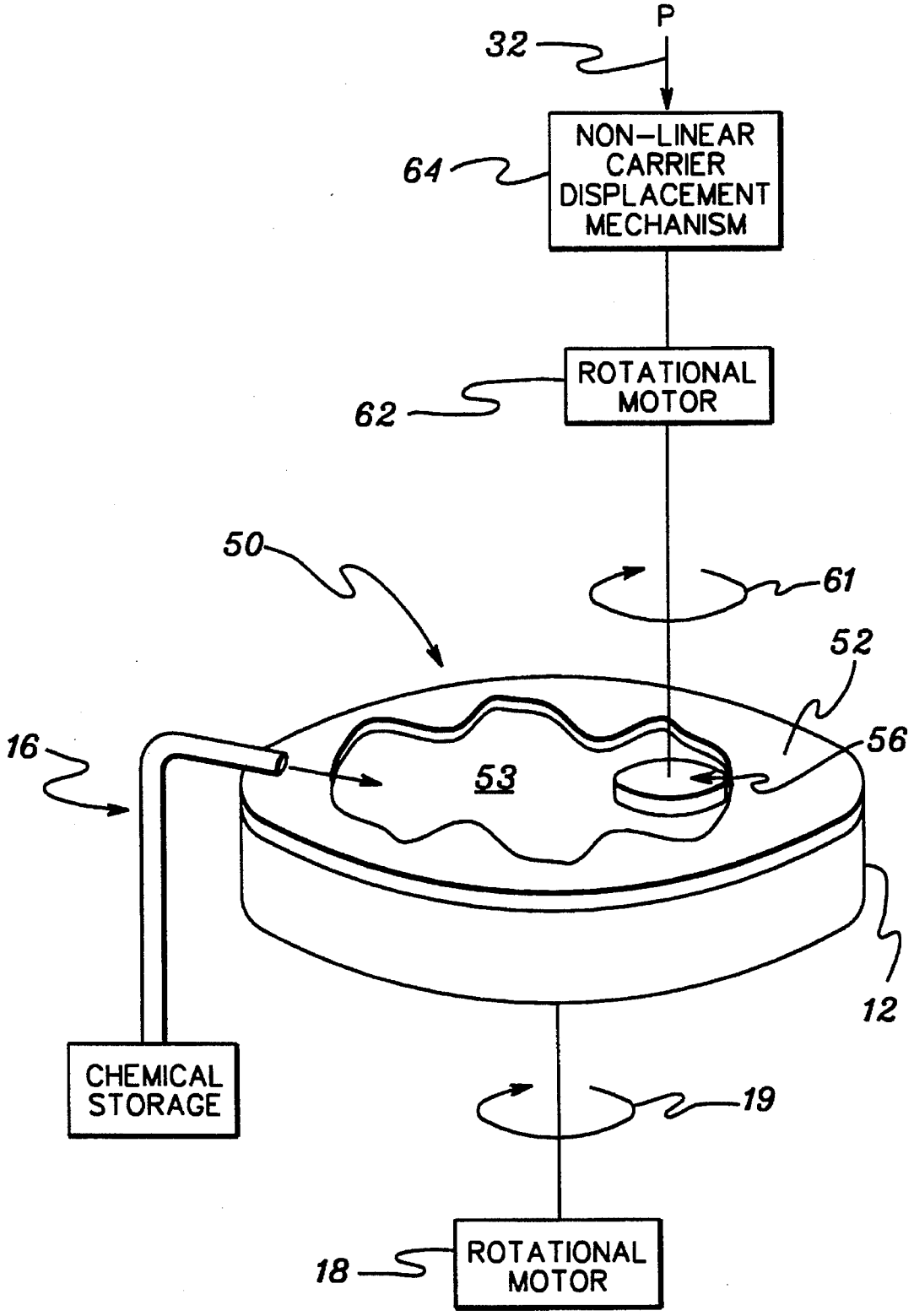
FIG. 2 is a diagrammatic perspective of one embodiment of a chemical mechanical planarization (CMP) device according to the present invention.
Figure 3:
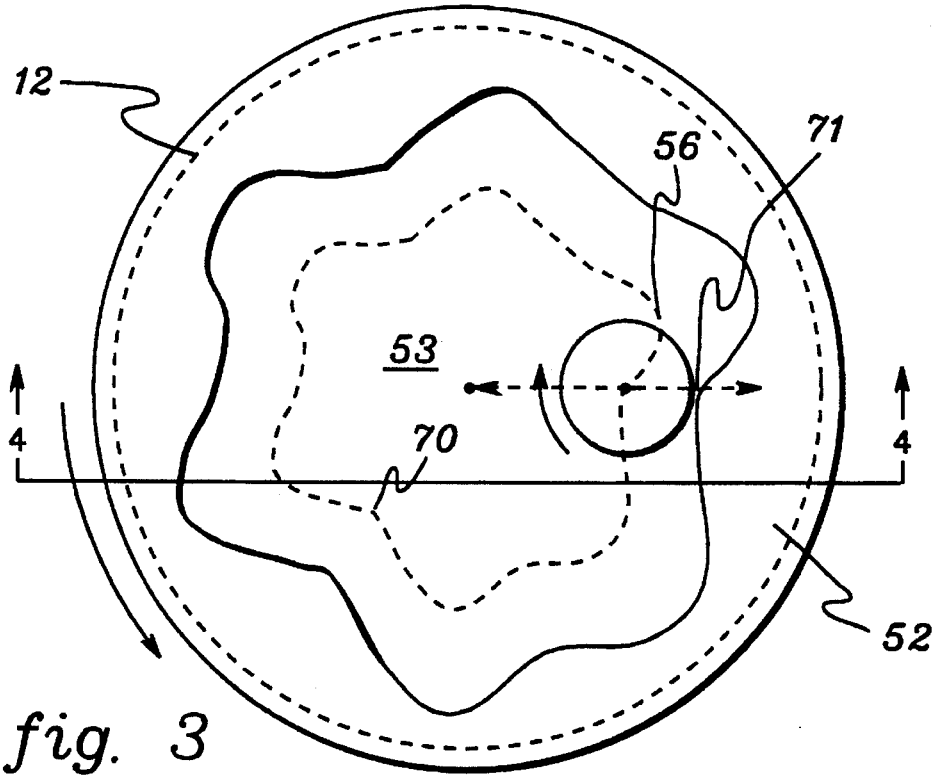
FIG. 3 is a top plan view of carrier and platen assemblies in accordance with the present invention, such as shown in FIG. 2.
Figure 4:
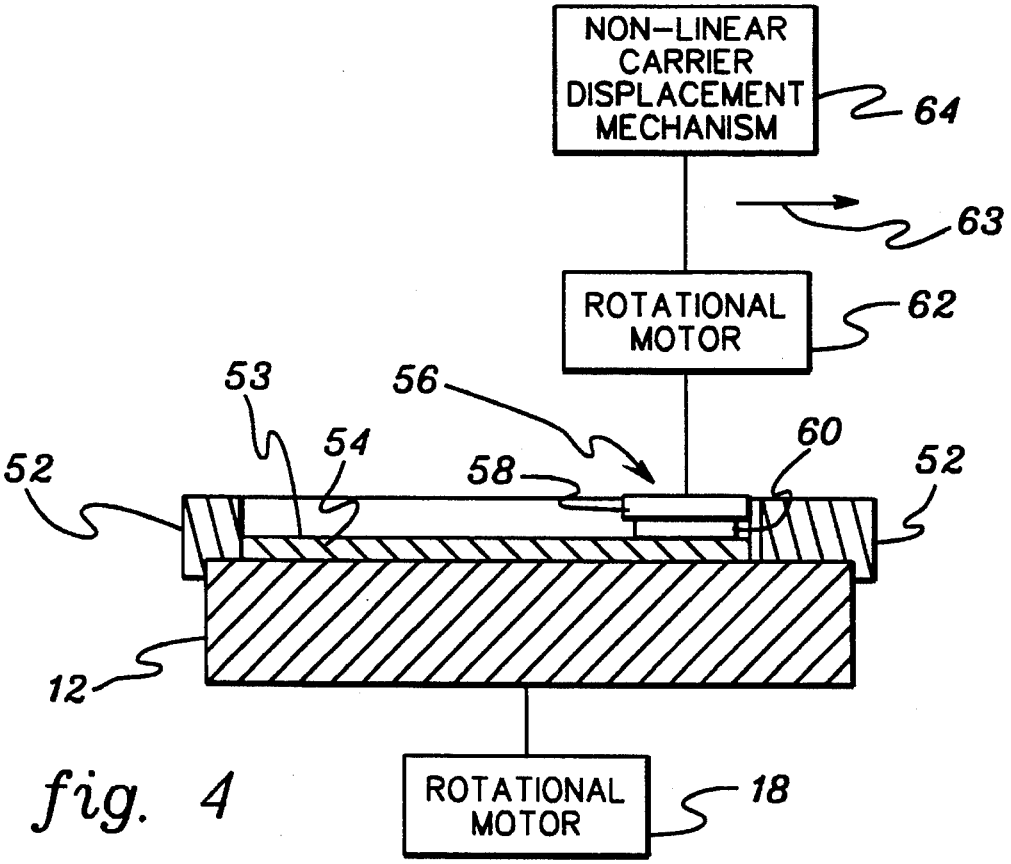
FIG. 4 is a partial cross-sectional view of the carrier and platen assemblies of the CMP device of FIGS. 2 & 3 taken along lines 4—4 of FIG. 3.

FIGS. 2–4 depict a template implemented embodiment of a chemical mechanical planarization device, generally denoted 50, in accordance with the present invention. As with CMP device 10 of FIG. 1, chemical mechanical planarization device 50 includes a motor 18 for rotating a platen 12, for example, in the direction indicated by arrow 19. Also, a chemical supply system 16 introduces polishing slurry for use as an abrasive medium as in the prior embodiment.

Device 50 differs from device 10 of FIG. 1 in that a template 52 is introduced atop platen 12. As shown, template 52 includes an opening 53 of irregular shape. Opening 53 exposes a polishing pad 54 residing atop platen 12. Pad 54 can comprise any commercially available polishing pad. A carrier assembly 56 includes a rotatable carrier 58 which vacuum holds a semiconductor wafer 60 such that the wafer surface to be polished is positioned in opposing relation to polishing pad 54. Carrier assembly 56 is rotated by rotational motor 62 and a non-linear carrier displacement mechanism 64 is configured to exert outward pressure in the direction of arrow 63 to ensure that carrier assembly 56 follows the irregular inner edge of template 52 as mechanism 64 moves the carrier assembly over polishing pad 54.

By maintaining carrier assembly 56 in contact with template 52, the carrier assembly will follow a varying path across polish pad 54 that is described by the shape of the template. Template 52 can be detachable from platen 12 such that different irregular shaped templates may be employed as desired. The irregular configuration of opening 53 in template 52 of FIGS. 2–4 is provided by way of example only. FIG. 3 shows in phantom an irregular X-Y path 70 of carrier assembly 56 over polishing pad 54 employing template 52. This irregular path 70 should be contrasted with the radial movement 71 employed in traditional CMP devices. By guiding the carrier assembly in such a predefined, varying path 70, slurry loading of the polishing pad is more evenly distributed over the polishing surface that the wafer contacts.

Numerous variations are possible, for example, template 52 may be physically spaced from platen 12 in order that the template may remain fixed notwithstanding rotation of platen 12. Further, a low friction material is preferably employed on the edges of carrier assembly 56 engaging template 52, as well as on the inner wall of template 52 in order to allow the carrier assembly to rotate independent of the platen/template assembly. To ensure independent movement, a bearing may be employed in association with the carrier assembly.

Figure 5:
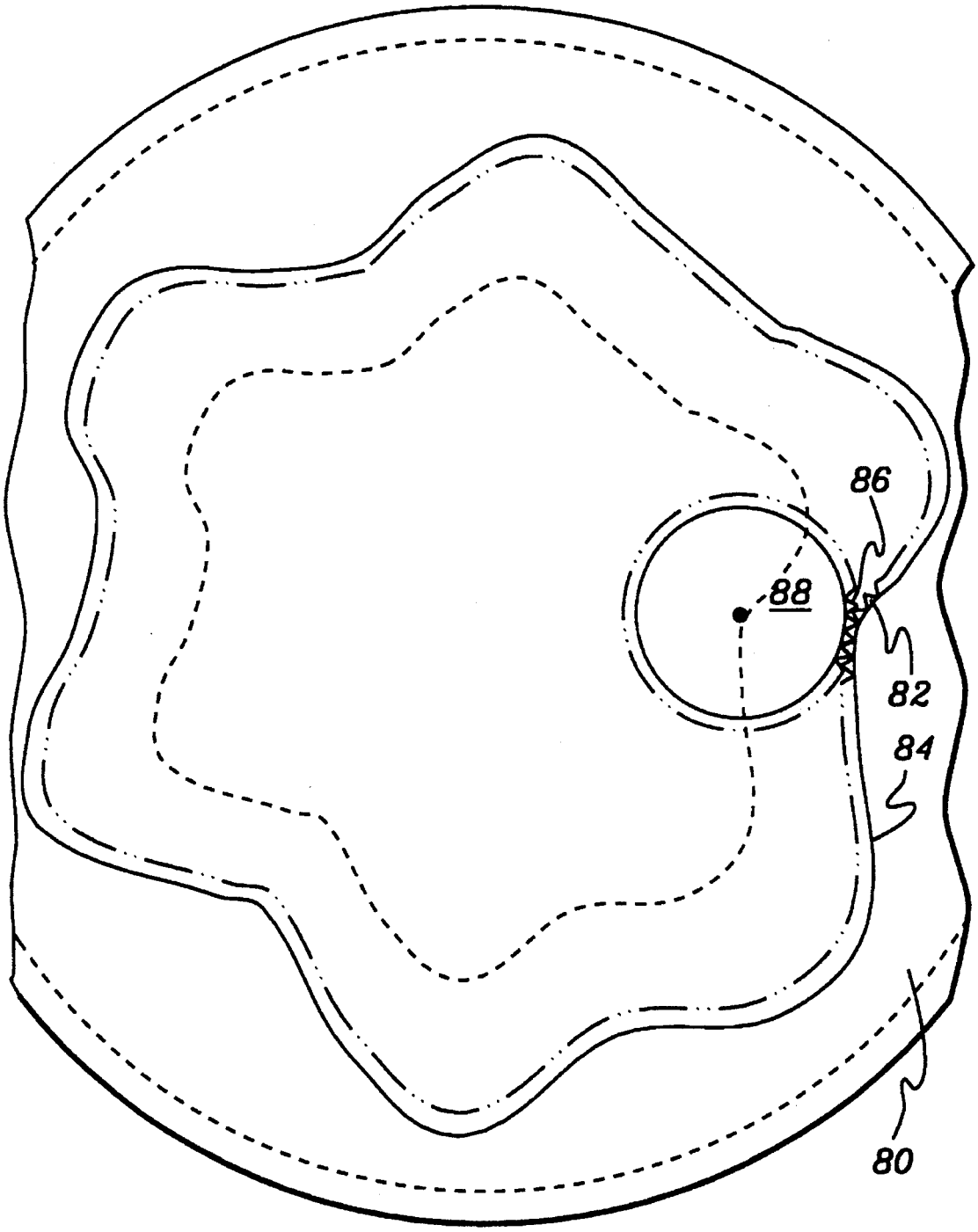
FIG. 5 is a partial plan view of carrier and platen assemblies in accordance with an alternate embodiment of the present invention.

As another variation, the template (FIG. 5) could be fabricated with teeth 82 on the inner edge 84 defining the irregular opening. Teeth 82 would be sized to mesh with teeth 86 on the carrier assembly 88. Through the meshing of these teeth, the carrier assembly is provided with a means of rotation through rotation of the platen to which template 80 would be secured. The need for a carrier motor drive is thus eliminated.

Figure 6:
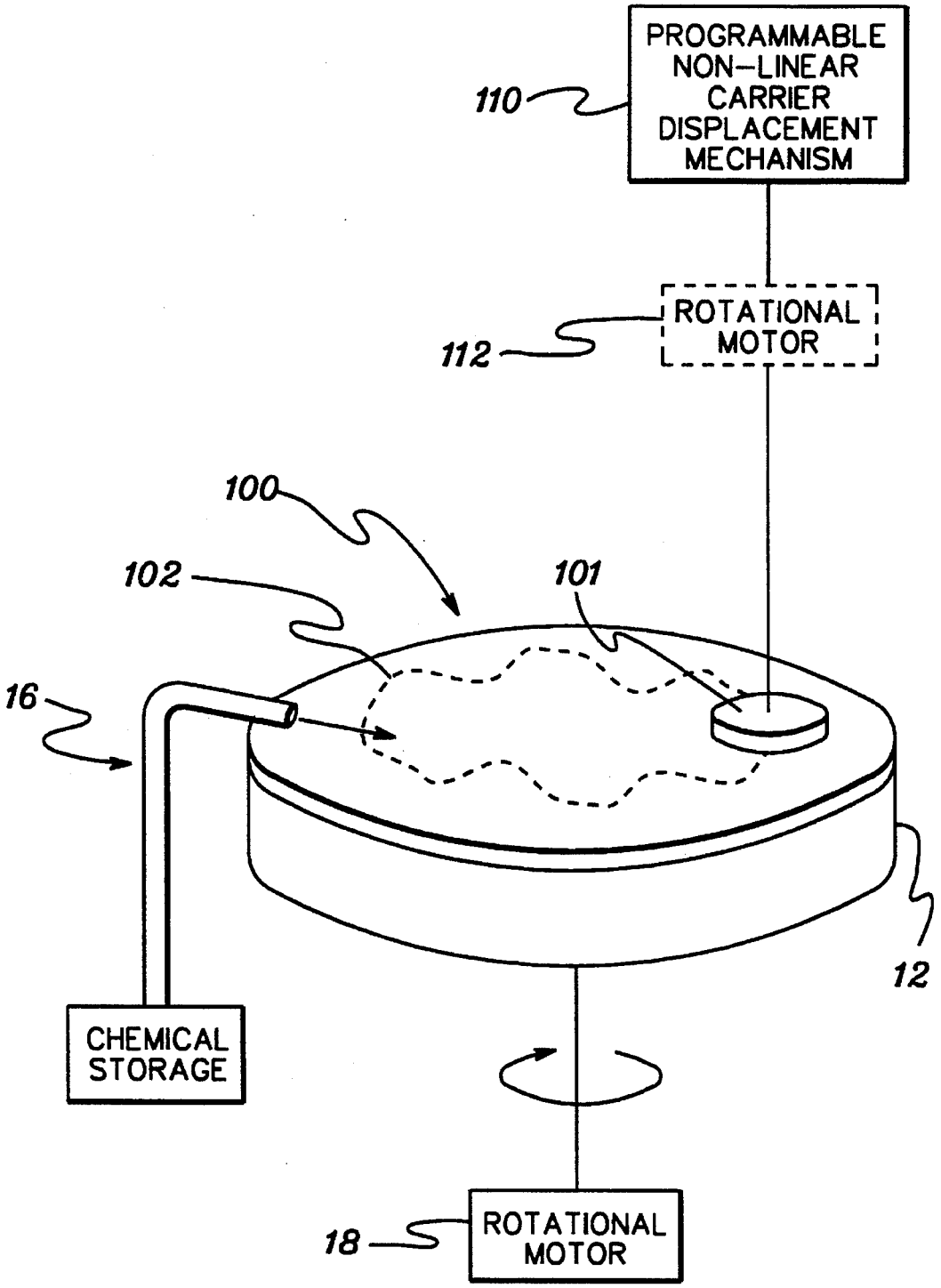
FIG. 6 is a diagrammatic perspective of an alternate embodiment of a chemical mechanical planarization (CMP) device in accordance with the present invention.

Another embodiment of a chemical mechanical planarization device, denoted 100, is depicted in FIG. 6. In this implementation, software control is employed to define an X-Y varying carrier path 102 over the polishing pad residing on platen 12. In particular, a programmable non-linear carrier displacement mechanism 110 moves carrier assembly 101 in the irregular path 102 over the polishing pad. The irregular movement involves variations in the rate of movement from the edge of the polishing pad to the center of the pad combined with variations in the distance traveled from the edge to the center of the polishing pad.

One of ordinary skill in the art will be able to implement programmable non-linear carrier displacement mechanism 110. For example, to create random movement using software, a programming function that chooses a value within a set of limits can be employed to specify the movement of the polishing arm. This function can have several different names depending upon the programming language used, and is sometimes referred to as a "SEED" or a "RAND" function. In all cases, this function allows for the software program to choose a value between some specified limits by using a modifier within the function (called a "MOD" operator) that provides the range of values which can be randomly chosen.

In addition to varying the path traveled by carrier assembly 101 over the polishing pad, use of a programmable displacement mechanism can allow selective rotation of the carrier assembly, programming of varying rotational rates, and programming of a Varying downward pressure applied to the carrier assembly. Programming of these various characteristics of the polishing function may be desirable since the exact location of the carrier assembly over the polishing pad would be known.

In all embodiments, the present invention comprises a chemical mechanical planarization device/method wherein the carrier assembly is non-rotationally moved in a non-linear, X-Y manner over the polishing pad. By guiding the carrier assembly in a set, irregular path, slurry loading of the polishing pad is more evenly distributed over the polishing surface that the wafer contacts. In the template embodiment presented, the CMP device design can be simplified because the carrier follows a predetermined path without the need for X-Y motor control of carrier movement. In the software driven embodiment, programmability of the carrier assembly path, rotational rate, and pressure with which the carrier/wafer engages the polishing pad can be provided. With the embodiments presented, no pad modification is required.

Although specific embodiments of the present invention have been illustrated in the accompanying drawings and described in the foregoing detailed description, it will be understood that the invention is not limited to the particular embodiments described herein, but is capable of numerous rearrangements, modifications and substitutions without departing from the scope of the invention. The following claims are intended to encompass all such modifications.

We claim:

1. A polishing device for polishing a surface of a semiconductor wafer, said polishing device comprising:

a polishing pad;

a carrier assembly for holding the semiconductor wafer with the surface thereof to be polished in juxtaposition relative to the polishing pad;

means for non-rotationally moving either the carrier assembly or the polishing pad such that the semiconductor wafer proceeds in a non-linear polishing path over the polishing pad, wherein said means for non-rotationally moving includes a template having an inner opening, said template being associated with said polishing pad such that said semiconductor wafer resides within the inner opening of the template when the semiconductor wafer is in juxtaposition relative to the polishing pad; and further comprising means for rotating the polishing pad, and wherein said template is spaced from said polishing pad so as to remain fixed notwithstanding rotation of the polishing pad.

2. A polishing device for polishing a surface of a semiconductor wafer, said polishing device comprising:

a polishing pad;

a carrier assembly for holding the semiconductor wafer with the surface thereof to be polished in juxtaposition relative to the polishing pad;

means for non-rotationally moving either the carrier assembly or the polishing pad such that the semiconductor wafer proceeds in a non-linear polishing path over the polishing pad, wherein said means for non-rotationally moving includes a template having an inner opening, said template being associated with said polishing pad such that said semiconductor wafer resides within the inner opening of the template when said semiconductor wafer is in juxtaposition relative to the polishing pad; and wherein said carrier assembly includes a carrier structure, and an inner edge of the template defines said inner opening therein, and wherein said means for non-rotationally moving includes means for moving the carrier assembly such that said carrier structure is in physical contact with the inner edge of said template.

3. A polishing device for polishing a surface of a semiconductor wafer, said polishing device comprising:

a polishing pad;

a carrier assembly for holding the semiconductor wafer with the surface thereof to be polished in juxtaposition relative to the polishing pad;

means for non-rotationally moving either the carrier assembly or the polishing pad such that the semiconductor wafer proceeds in a non-linear polishing path over the polishing pad, wherein said means for non-rotationally moving comprises a programmable control means for non-rotationally moving either the carrier assembly or the polishing pad such that the semiconductor wafer follows a non-linear polishing path to the polishing pad; and wherein said carrier assembly includes a carrier having a carrier arm connected thereto, said semiconductor wafer being held by said carrier, said carrier arm disposing said carrier and said semiconductor wafer over said polishing pad such that the surface of said semiconductor wafer to be polished is in juxtaposition relative to the polishing pad, said programmable control means being associated with said carrier arm so as to non-rotationally move said carrier and said semiconductor wafer over said polishing pad such that the semiconductor wafer follows the non-linear polishing path over the polishing pad.

4. A polishing device for polishing a surface of a semiconductor wafer, said polishing device comprising:

a polishing pad;

a carrier assembly for holding the semiconductor wafer with the surface thereof to be polished in juxtaposition relative to the polishing pad;

means for non-rotationally moving either the carrier assembly or the polishing pad such that the semiconductor wafer proceeds in a non-linear polishing path over the polishing pad, wherein said means for non-rotationally moving comprises a programmable control means for non-rotationally moving either the carrier assembly or the polishing pad such that the semiconductor wafer follows a non-linear polishing path relative to the polishing pad; and wherein said programmable control means is associated with said carrier assembly, and wherein said programmable control means includes means for varying the rate of rotation of said carrier assembly;

means for varying the non-linear polishing path of said semiconductor wafer across said polishing pad; and means for varying the rate of movement of said semiconductor wafer along said non-linear polishing path over said polishing pad.

5. A process for planarizing a semiconductor wafer comprising the steps of:

(a) rotating a pad;

(b) holding a surface of a semiconductor wafer in juxtaposition relative to the pad;

(c) non-rotationally moving the semiconductor wafer non-linearly over the pad such that the semiconductor wafer travels in an x-y varying path over the pad;

(d) rotating the semiconductor wafer simultaneous with said non-rotationally moving step (c); and (e) time varying said non-rotational moving of said step (c) and time varying said rotating of said semiconductor wafer.

* * * * *